US007801768B2

(12) United States Patent
Jain et al.

(10) Patent No.: US 7,801,768 B2
(45) **Date of Patent: *Sep. 21, 2010**

(54) BUDGET-DEPENDENT PSEUDO BID IN AUCTION

(75) Inventors: Kamal Jain, Bellevue, WA (US); Kunal Talwar, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 1191 days.

This patent is subject to a terminal disclaimer.

(21) Appl. No.: 11/227,545

(22) Filed: Sep. 15, 2005

(65) Prior Publication Data

US 2007/0061216 A1 Mar. 15, 2007

(51) Int. Cl.
*G06Q 30/00* (2006.01)

(52) U.S. Cl. ..... 705/26

(58) Field of Classification Search ..... 705/26
See application file for complete search history.

(56) References Cited

U.S. PATENT DOCUMENTS

| | | | | |
|---|---|---|---|---|
| 2002/0049642 | A1 | 4/2002 | Moderegger et al. | |
| 2003/0018560 | A1 * | 1/2003 | Dietrich | 705/37 |
| 2003/0135460 | A1 * | 7/2003 | Talegon | 705/40 |
| 2003/0220918 | A1 * | 11/2003 | Roy et al. | 707/3 |
| 2004/0088241 | A1 * | 5/2004 | Rebane et al. | 705/37 |
| 2005/0033682 | A1 * | 2/2005 | Levy et al. | 705/37 |
| 2005/0209953 | A1 * | 9/2005 | Stubbs et al. | 705/37 |
| 2006/0136320 | A1 * | 6/2006 | Saberi et al. | 705/37 |
| 2006/0224447 | A1 * | 10/2006 | Koningstein | 705/14 |
| 2007/0005421 | A1 * | 1/2007 | Labio et al. | 705/14 |
| 2007/0011078 | A1 * | 1/2007 | Jain et al. | 705/37 |
| 2007/0038508 | A1 * | 2/2007 | Jain et al. | 705/14 |
| 2007/0038509 | A1 * | 2/2007 | Jain et al. | 705/14 |

FOREIGN PATENT DOCUMENTS

| | | |
|---|---|---|
| KR | 20000024156 | 5/2000 |
| KR | 20010000044 | 1/2001 |
| KR | 20020005536 | 1/2002 |

OTHER PUBLICATIONS

PCT International Search Report and Written Opinion for Application No. PCT/US2006/036126 mailed on Jan. 23, 2007 pp. 1-9.

* cited by examiner

*Primary Examiner*—Jagdish N Patel
*Assistant Examiner*—Sara Chandler
(74) *Attorney, Agent, or Firm*—Lee & Hayes, PLLC

(57) ABSTRACT

In auctioning items, pseudo bids are determined based on the bid price and auction budget submitted by a bidder. The bid associated with the highest pseudo bid is identified as the winning bid. A consistent pseudo bid function is applied to determine the pseudo bids for each of the bids, or a variable pseudo bid function is selectively applied to some bids. The pseudo bid increases with increased bid prices and/or increased auction budgets. When a winning bid is identified, the winner's auction budget is debited the price of the item won, and the pseudo bid is recalculated using the remaining auction budget. Bidders submitting higher auction budgets are rewarded by being able to win more items because their auction budgets increase their pseudo bids. Recalculating pseudo bids based on remaining auction budgets allows different bidders to alternately win successive rounds as previous winners'auction budgets are reduced.

12 Claims, 7 Drawing Sheets

400

| BIDDER | BID PRICE | BUDGET |
|---|---|---|
| A 410 | $0.06 412 | $1.50 414 |
| B 420 | $0.06 422 | $1.00 424 |
| C 430 | $0.05 432 | $2.50 434 |

*FIGURE 4*

500

| BIDDER | REMAINING BUDGET | PSEUDO BID | RANK |
|---|---|---|---|
| A 410 | $1.50 514 | $0.040 510 | 1 512 |
| B 420 | $1.00 524 | $0.030 520 | 3 522 |
| C 430 | $2.50 534 | $0.038 530 | 2 532 |

*FIGURE 5*

600

| Bidder | Bid Price | Total Budget |
|---|---|---|
| A 610 | $0.05 612 | $1.50 614 |
| B 620 | $0.06 622 | $1.00 624 |
| C 630 | $0.04 632 | $2.40 634 |

*FIGURE 6*

| Rnd | Bdr | Rem. Budget | Pseudo Bid | Next Winner |
|---|---|---|---|---|
| 0 700 | A | $1.50 614 | $0.03000 702 | B 708 |
| | B | $1.00 624 | $0.03000 704 | |
| | C | $2.40 634 | $0.02750 706 | |

| Rnd | Bdr | Rem. Budget | Pseudo Bid | Next Winner |
|---|---|---|---|---|
| 1 710 | A | $1.50 | $0.03000 716 | A 718 |
| | B | $0.94 712 | $0.02809 714 | |
| | C | $2.40 | $0.02750 | |

| Rnd | Bdr | Rem. Budget | Pseudo Bid | Next Winner |
|---|---|---|---|---|
| 2 720 | A | $1.45 722 | $0.02931 724 | A 728 |
| | B | $0.94 | $0.02809 726 | |
| | C | $2.40 | $0.02750 | |

| Rnd | Bdr | Rem. Budget | Pseudo Bid | Next Winner |
|---|---|---|---|---|
| 3 730 | A | $1.40 732 | $0.02857 734 | A 738 |
| | B | $0.94 | $0.02809 736 | |
| | C | $2.40 | $0.02750 | |

| Rnd | Bdr | Rem. Budget | Pseudo Bid | Next Winner |
|---|---|---|---|---|
| 4 740 | A | $1.35 742 | $0.02778 744 | B 748 |
| | B | $0.94 | $0.02809 746 | |
| | C | $2.40 | $0.02750 | |

| Rnd | Bdr | Rem. Budget | Pseudo Bid | Next Winner |
|---|---|---|---|---|
| 5 750 | A | $1.35 | $0.02778 | A 758 |
| | B | $0.88 752 | $0.02591 754 | |
| | C | $2.40 | $0.02750 756 | |

| Rnd | Bdr | Rem. Budget | Pseudo Bid | Next Winner |
|---|---|---|---|---|
| 6 760 | A | $1.30 762 | $0.02692 764 | C 768 |
| | B | $0.88 | $0.02591 | |
| | C | $2.40 | $0.02750 766 | |

| Rnd | Bdr | Rem. Budget | Pseudo Bid | Next Winner |
|---|---|---|---|---|
| 7 770 | A | $1.30 | $0.02692 776 | C 778 |
| | B | $0.88 | $0.02591 | |
| | C | $2.36 772 | $0.02729 774 | |

| Rnd | Bdr | Rem. Budget | Pseudo Bid | Next Winner |
|---|---|---|---|---|
| 8 780 | A | $1.30 | $0.02692 786 | C 788 |
| | B | $0.88 | $0.02591 | |
| | C | $2.32 782 | $0.02707 784 | |

| Rnd | Bdr | Rem. Budget | Pseudo Bid | Next Winner |
|---|---|---|---|---|
| 9 790 | A | $1.30 | $0.02692 796 | A 798 |
| | B | $0.88 | $0.02591 | |
| | C | $2.28 792 | $0.02684 794 | |

*FIGURE 7*

800

| Bidder | Bid Price | Total Budget |
|---|---|---|
| A 802 | $2.00 804 | $50.00 806 |
| B 812 | $2.08 814 | $35.00 816 |
| C 822 | $1.95 824 | $70.00 826 |

*FIGURE 8*

| Rnd | Bdr | Rem. Budget | Pseudo Bid | Winner/ Cost |
|---|---|---|---|---|
| 0 900 | A | $50.00 806 | $1.80000 902 | C $1.94 908 |
| | B | $35.00 816 | $1.79429 904 | |
| | C | $70.00 826 | $1.80714 906 | |

| Rnd | Bdr | Rem. Budget | Pseudo Bid | Winner/ Cost |
|---|---|---|---|---|
| 1 910 | A | $50.00 | $1.80000 916 | C $1.95 918 |
| | B | $35.00 | $1.79429 | |
| | C | $68.06 912 | $1.80307 914 | |

| Rnd | Bdr | Rem. Budget | Pseudo Bid | Winner/ Cost |
|---|---|---|---|---|
| 2 920 | A | $50.00 | $1.80000 926 | A $2.00 928 |
| | B | $35.00 | $1.79429 | |
| | C | $66.11 922 | $1.79874 924 | |

| Rnd | Bdr | Rem. Budget | Pseudo Bid | Winner/ Cost |
|---|---|---|---|---|
| 3 930 | A | $48.00 932 | $1.79167 934 | C $1.95 938 |
| | B | $35.00 | $1.79429 | |
| | C | $66.11 | $1.79874 936 | |

| Rnd | Bdr | Rem. Budget | Pseudo Bid | Winner/ Cost |
|---|---|---|---|---|
| 4 940 | A | $48.00 | $1.79167 | B $2.08 948 |
| | B | $35.00 | $1.79429 946 | |
| | C | $64.16 942 | $1.79414 944 | |

| Rnd | Bdr | Rem. Budget | Pseudo Bid | Winner/ Cost |
|---|---|---|---|---|
| 5 950 | A | $48.00 | $1.79167 956 | A $2.00 958 |
| | B | $32.92 952 | $1.77623 954 | |
| | C | $64.16 | $1.79414 | |

*FIGURE 9*

| RND | BDR | REM. BUDGET | PSEUDO BID | WINNER/ COST |
|---|---|---|---|---|
| 0 1000 | A | $50.00 | $1.80000 1002 | B $2.07 1006 |
| | B | $35.00 | $1.82286 1004 | |
| | C | $70.00 | $1.80714 1006 | |

| RND | BDR | REM. BUDGET | PSEUDO BID | WINNER/ COST |
|---|---|---|---|---|
| 1 1010 | A | $50.00 | $1.80000 | C $1.95 1018 |
| | B | $32.93 1012 | $1.80669 1014 | |
| | C | $70.00 | $1.80714 1016 | |

| RND | BDR | REM. BUDGET | PSEUDO BID | WINNER/ COST |
|---|---|---|---|---|
| 2 1020 | A | $50.00 | $1.80000 | B $2.07 1028 |
| | B | $32.93 | $1.80669 1026 | |
| | C | $68.05 1022 | $1.80305 1024 | |

*FIGURE 10*

BUDGET-DEPENDENT PSEUDO BID IN AUCTION

BACKGROUND

Internet search engines, web-based mail, on-line reference sources, television programming guides, and providers of similar services earn revenue by presenting selectable advertisements. The ads may be directed to any person likely to use the service, or the ads may be targeted to those whose on-line activities indicate interest in a particular type of good or service.

For example, FIG. 1 shows a search engine web page 100 that allows a person to perform a web search. To initiate the search, the person enters a search 102, consisting of one or more search terms, in a search field 104. The person then selects or "clicks" on a search button 106 by directing a pointing device (not shown) to position a cursor 108 over the search button 104 and pressing a button on the pointing device. In this example, the user performs a search 102 consisting of the term "Camera."

As shown in FIG. 2, the search engine returns a results screen 200 listing links 202 to web pages relevant to the search 102 (FIG. 1). The links 202 are presented and ranked according to their relevance to the search 102. In addition to the links 202, the results screen 200 also includes banner ads 204 and 206 and sponsored links 208, 210, and 212.

Banner ad 204, displayed prominently across the top of results page 200, presents an ad for "BOB'S CAMERA." Banner ad 206, displayed aside of results screen 200, presents a banner ad for "DISCOUNT CAMERAS." On another side of results screen 200, a number of sponsored links 208, 210, and 212 are presented, each of which also represents a camera seller or another good or service pertaining to cameras. Pop-up windows (not shown), which present another window over results screen 200, also may be used to present ads.

If the user wants to learn more about or purchase what is described in one of the ads 204 and 206 or sponsored links 208, 210, and 212, the user positions a cursor 214 over the ad or link and selects it. The likelihood of the user selecting an ad increases if the ad concerns a good or service of interest to the user. Thus, it is not a coincidence that the results screen 200 for the user's search 102 (FIG. 1) on the term "Camera" presented advertisements for camera vendors in ads 204 and 206 and sponsored links 208, 210, and 212. An advertiser arranges with service providers for its ads to be presented when a user shows an interest in the advertiser's business.

Typically, advertisers agree to pay the search engine provider either each time one of the advertiser's ads either is presented, or each time one of the advertiser's ads is selected or "clicked" by a user. Presumably, ads are selected by users who wish to evaluate or purchase the advertiser's goods or services. Because an ad may be shown dozens or hundreds of times before a user clicks the ad, advertisers who wish to pay per selection or "per click" will pay a higher unit price than advertisers who choose to pay "per showing" or "per impression."

Typically, the advertising opportunities, such as ads 204 and 206 and sponsored links 208, 210, and 212, are sold to advertisers by auction. Advertisers submit bids for advertising opportunities that arise, for example, when a user performs a search including one or more terms describing the advertiser's business. In the case of a results page 200 including multiple advertising opportunities in both ads 204 and 206 and sponsored links 208, 210, and 212, multiple advertising opportunities are auctioned for each results page.

The advertisers' bids each include a bid price and an auction budget. The bid price specifies a maximum price an advertiser is willing to pay for an advertising opportunity, and the auction budget specifies a total sum of money the advertiser is willing to spend on ads in a particular auction. More specifically, the bid price includes a "per impression" or "per showing" bid if the advertiser desires or is willing to pay each time one of its advertisements is presented. Alternatively, advertisers may submit bids that include a "per selection" or "per click" bid if the advertiser desires to or is willing to pay each time a user selects one of its advertisements.

Auctioning advertising opportunities according to such conventional means may lead to a number of undesirable results for advertisers. First, an advertiser who presents the highest bid may win all of the advertising opportunities available early in the auction period, but will have its auction budget depleted early in the auction period. Second, conversely, an advertiser who presents a relatively low bid but a large budget may not win any advertising opportunities early in the auction period. Once other advertisers' auction budgets are depleted, the advertiser may win all the available advertising opportunities at the end of the auction period. However, the low-bidding advertiser may be very dissatisfied at having failed to win advertising opportunities until the end of the auction period.

In both of these cases, the advertisers may be dissatisfied and, as a result, may change their bidding practices. The high-bidding advertiser may bid lower, hoping to stretch its auction budget and win a larger number of advertisements. However, if the previous high bidder bids too low, it may win few or no advertising opportunities. On the other hand, the low-bidding advertiser may raise its bid, hoping to win advertising opportunities earlier in the auction. However, with the previous high bidder lowering its bid, the previous low bidder may find its auction budget depleted early during the course of the auction and become dissatisfied for the same reasons as the previous high bidder. As a result, both advertisers may become frustrated by the process, and invest less of their advertising budgets on these advertising opportunities. Even worse, the advertisers may cease bidding on advertising opportunities entirely.

It is a significant problem for advertising providers when advertisers reduce their bids for advertising opportunities, or cease bidding entirely. It would be in the best interest of advertising providers to conduct auctions so that high-bidding advertisers will be able to win advertising opportunities over an extended period of time instead of winning opportunities only early in the auction. Further, it would be in the best interest of advertising providers to ensure that bidders who commit a large auction budget have a better chance to win advertising opportunities. Advertising providers not only want to earn at least a portion of such large budgets, but also want bidders submitting high budgets to be satisfied so that they will not take their advertising business elsewhere.

SUMMARY

In auctioning items, pseudo bids are determined based on the bid price and auction budget submitted by a bidder. The bid associated with the highest pseudo bid is identified as the winning bid. A consistent pseudo bid function is applied to determine the pseudo bids for each of the bids, or a variable pseudo bid function is selectively applied to some bids. The pseudo bid increases with increased bid prices and/or increased auction budgets. When a winning bid is identified, the winner's auction budget is debited the price of the item won, and the pseudo bid is recalculated using the remaining auction budget Bidders submitting higher auction budgets are rewarded by being able to win more items because their auction budgets increase their pseudo bids. Recalculating pseudo bids based on remaining auction budgets allows different bidders to alternately win successive rounds as previous winners'auction budgets are reduced.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit of a reference number identifies the figure in which the reference number first appears. The use of the same reference numbers in different figures indicates similar or identical items.

FIG. 4 is a set of per-impression bids.

FIG. 5 is an exemplary set of pseudo bids generated for the set of bids of FIG. 4.

FIG. 6 is a set of per-impression bids.

FIG. 7 is a set of auction results for the set of bids of FIG. 6. using a mode of conducting an auction using pseudo bids.

FIG. 8 is a set of per-selection bids.

FIGS. 9 and 10 are sets of auction results for the set of bids of FIG. 8 conducted using different modes of conducting an auction using pseudo bids.

DETAILED DESCRIPTION

Figure 1:
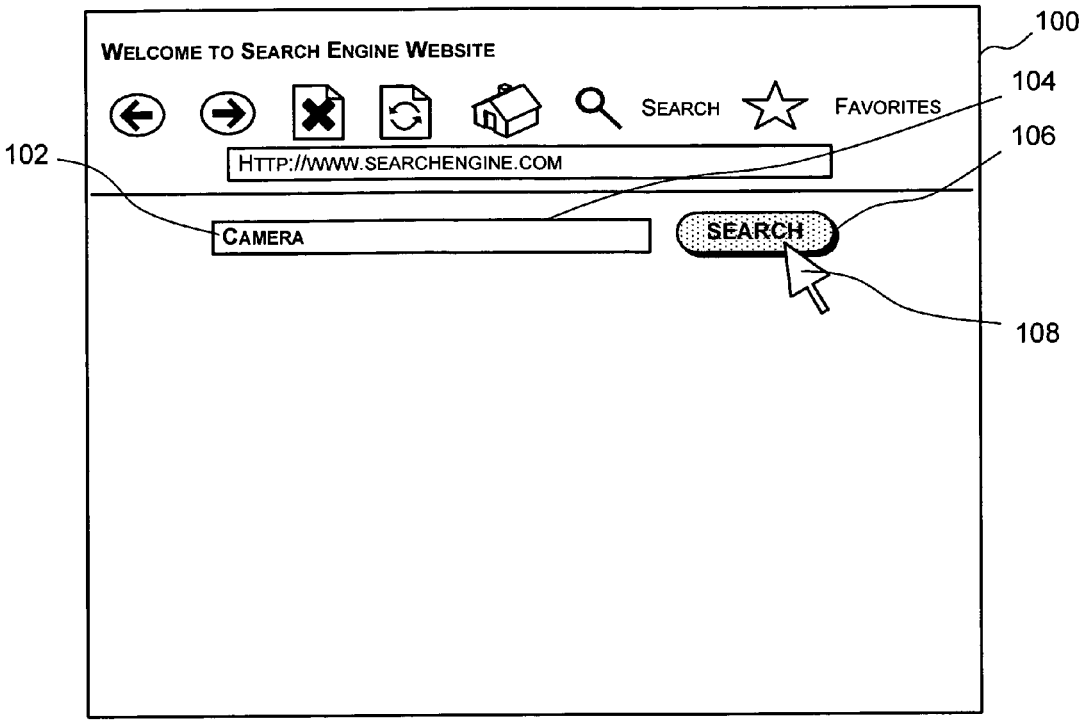
FIGURE 1 (PRIOR ART)
FIGS. 1 and 2 (Prior Art) are screens illustrating results of a search presenting a number of ads.

Embodiments of the present invention provide for items, such as advertising opportunities, to be auctioned based on pseudo bids determined as a function of both a bid price and an auction budget submitted by a bidder. Accordingly, in one mode, a pseudo bid associated with a first bid including a high bid price but a low auction budget will be lower than a pseudo bid associated with a second bid including the same price and a higher auction budget. Thus, an item auctioned will go to the second bidder submitting the second bid to reward the second bidder for submitting a higher auction budget.

However, the first bidder submitting the first bid also benefits. In a conventional auction, the first bidder submitting the high bid price would win the first auctions but quickly exhaust its auction budget. In the case of advertising opportunities, this is undesirable because the first bidder's ads may reach a few persons early in the auction, but will not reach any users later in the auction. By contrast, according to a mode using pseudo bids, the first bidder may be able to participate in the auction over a longer period.

As the second bidder wins advertising opportunities, the second bidder's auction budget will be debited for the items the second bidder wins. As the second bidder's auction budget is diminished, the pseudo bid associated with the first bid will exceed that of the pseudo bid associated with the second bid, and the first bidder will win the next advertising opportunity. As the auction continues, both bidders'auction budgets will be debited repeatedly. Each time one bidder's budget is debited, its pseudo bid will be reduced. This potentially results in a different bidder presenting a higher pseudo bid for the next advertising opportunity. This allows that other bidder to win the next advertising opportunity, thereby spreading the allocation of advertising opportunities among the bidders.

Moreover, the price for which each advertising opportunity is sold may be determined in a Vickery-type based on a pseudo bid of a next lower bidder. A Vickery-type auction is a truth-telling type auction because bidders are encouraged to bid what they believe the item to be worth, because the selling price is set by the second highest bid. If a bidder bids untruthfully at a level below that the bidder is willing to pay, the bidder's choice of bid may reduce the price for a competing bidder who submitted a truthful bid price. Thus, a Vickery-type auction encourages truthful bidding. Therefore, a Vickery-type auction, at least within each iteration of the auction, is a truth-telling auction.

In a Vickery-type auction, using the pseudo bid function to determine what bid price a bidder would have had to submit to yield the pseudo bid of the next lower bidder, the bidder may be able to purchase the advertising opportunity at a price below the bid price. As a result, the bidder not only will be able to purchase advertising opportunities at prices below the bid price, the bidder's auction budget will be depleted less quickly. This potentially allows the bidder to participate in the auction for a longer period and purchase more advertising opportunities, potentially increasing bidder satisfaction.

Auctioning Items Based on Pseudo Bids

Figure 3:
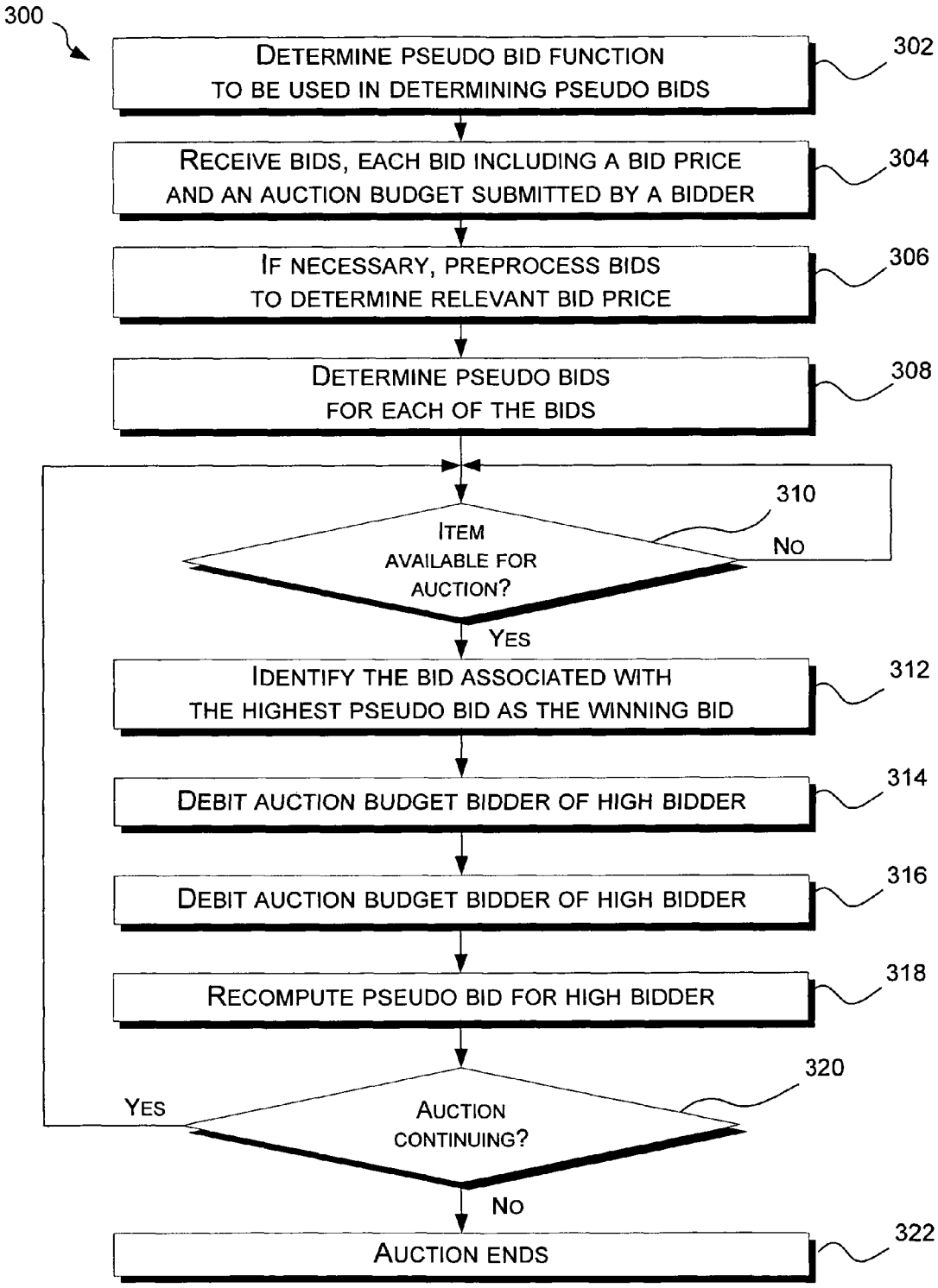
FIG. 3 is a flow diagram illustrating the logical steps of a mode of using budget-dependent pseudo bids in an auction.

FIG. 3 is a flow diagram of a mode of a process 300 for auctioning items, such as advertising opportunities, using pseudo bids. At 302, the pseudo bid function to be used in determining pseudo bids is determined. The pseudo bid is determined using a pseudo bid function that depends both on the bid price and the auction budget submitted by the advertiser in its auction bid, as indicated in Eq. (1):

$$\text{pseudo bid} = f(\text{bid price, auction budget}) \tag{1}$$

In one mode, the pseudo bid function is directly related to the bid price and the auction budget. As a result, a bid presenting a higher bid price and/or a higher auction budget will be assigned a higher-pseudo bid than a bid having a lower bid price and/or auction budget.

A number of suitable pseudo bid functions may be used to determine pseudo bids. Eqs. (2)-(4) list three exemplary pseudo bid functions:

$$\text{pseudo bid} = \text{bid price} - \frac{\lambda}{\text{auction budget}} \tag{2}$$

$$\text{pseudo bid} = \text{bid price} - e^{-\lambda \cdot \text{auction budget}} \tag{3}$$

$$\text{pseudo bid} = \text{bid price} \cdot \left(1 - \frac{\lambda}{\text{auction budget}}\right) \tag{4}$$

In Eqs. (2)-(4), the value of the pseudo bid increases with increasing bid prices. In addition, although the value of the pseudo bid is reduced by a term including the auction budget, the larger the auction budget, the smaller is the reduction to the bid price. In one mode, the term $\lambda$ is a constant that can be set to adjust the offset to the bid price in the pseudo bid. The smaller the value of $\lambda$, the less an increase in the auction budget affects the pseudo bid.

Considering the example of Eq. (2), if the bid price remains constant and the auction budget is increased, the value of λ divided by the auction budget decreases, resulting in a smaller offset to the bid price. Similarly, in Eq. (3), if the bid price remains constant and the auction budget is increased, the value of e raised to −λ multiplied by the auction budget decreases, also resulting in a smaller offset to the bid price. Also similarly, in Eq. (4), if the bid price remains constant and the auction budget is increased, the value of λ divided by the auction budget decreases. Thus, the quantity 1 minus the value of λ divided by the auction budget will be larger for larger auction budgets, resulting in a smaller offset to the bid price. Thus, using Eqs. (2), (3), or (4) as a pseudo bid function, if two bidders submit bids including the same bid price, but one submits a larger auction budget, the bidder submitting the larger auction budget will be assigned a larger pseudo bid. The bidder submitting the larger auction budget will have its bid price offset by a smaller amount than the bidder submitting the smaller auction budget.

In addition, the pseudo bid may be dependent on values and functions in addition to the bid price and the auction budget. For example, some auctions are conducted over a period of days, with each day representing an auction period. Accordingly, bids submitted include one or more bid prices, a daily auction budget for each day of the auction, and a total auction budget. Thus, to encourage bidders to submit high auction budgets, it may be desirable to employ a pseudo bid function as defined by Eq. (5):

$$\text{pseudo bid} = \text{bid price} \cdot \left(1 + \frac{\lambda \cdot \text{total auction budget}}{\text{daily auction budget}}\right) \tag{5}$$

The pseudo bid function of Eq. (5) also has the benefit of the monetary units of the total auction budget and daily auction budget canceling each other, resulting in the pseudo bid being expressed in the same units as the bid price.

To further facilitate even distribution of auction items, the pseudo bid may include a statistical term to adapt the pseudo based on expected rate of distribution of the auction items. More particularly, in the case of auctioning advertising opportunities, such a statistical term may be used to correlate the proportion of auction budget remaining relative to the expected number of advertising opportunities remaining. For example, in an ideal distribution of advertising opportunities, at a point during the auction period when usually half of the advertising opportunities have been auctioned, the bidder should have spent approximately half of its budget for the auction period. For another example, if the auction period is a day, and by noon usually seventy-five percent of the traffic resulting in advertising opportunities has been received, ideally seventy-five percent of the bidder's auction budget for the period should be exhausted.

Thus, an appropriate, statistically dependent pseudo bid function is defined by Eq. (6):

$$\text{pseudo bid} = \text{bid } pr \cdot \lambda \cdot \left(\frac{\textit{rem.}\ \text{portion of budget for period}}{\textit{rem.}\ \text{portion of } \textit{adv.}\ \text{opportunites for period}}\right) \tag{6}$$

In Eq. (6), the remaining portion of the auction budget for the period is determined by subtracting from the bidder's auction budget for the period the portion of the bidder's auction budget for the period that has been spent. Similarly, an expected remaining portion of available advertising opportunities is determined based on an historical or estimated projection of the advertising opportunities that remain in the period. In Eq. (6), the remaining portions are expressable as fractions or percentages because, as long as both portions are expressed as either fractions or percentages, the units will cancel each other.

Using a statistical function as expressed in Eq. (6) will adjust a bidder's pseudo bid to correlate with the portion of items remaining for auction. Thus, where the portion of the remaining portion of the bidder's auction budget for the period is less than the remaining portions of items to be auctioned, the product of the bid price and λ will be reduced by the ratio of the remaining portion of the budget to the remaining portion of items to be auctioned. On the other hand, where the portion of the remaining portion of the bidder's auction budget for the period exceeds the remaining portion of items to be auctioned, the product of the bid price and λ will be increased by the ratio of the remaining portion of the budget to the remaining portion of items to be auctioned. In sum, as illustrated by the exemplary pseudo bid functions described, myriad pseudo bid functions suitably are used to generate an appropriate pseudo bid based on the bid price, the auction budget, and/or other factors.

Referring again to FIG. 3, at 304, bids are received from the bidders. Each of the bids includes both a bid price, specifying a maximum that a bidder is willing to pay for an item, and an auction budget, specifying the total sum that the bidder is willing to spend on items in the auction.

FIG. 4 shows an exemplary set of bids 400 submitted by three bidders, Bidder A 410, Bidder B 420, and Bidder C 430. Bidder A 410 submits a bid price 412 of $0.06 per impression and an auction budget of 414 $1.50. Bidder B 420 also submits a bid price 422 of $0.06 per impression but, unlike Bidder A 410, Bidder B 420 submits an auction budget of 424 $1.00. Bidder C 430 submits a bid price 432 of $0.05 per impression, and an auction budget 434 of $2.50. The set of bids 400 will be used to provide an example of the determination of pseudo bids, as is described below.

Referring to FIG. 3, at 306, if necessary, the bids are preprocessed to determine a relevant bid price. In the case of auctions for advertising opportunities, advertising providers may auction advertising opportunities on a per impression or per selection basis as previously described. Thus, for example, if a bidder submitted a per impression bid when the auction is to be conducted on a per selection basis, the advertising provider can determine a constructive, per selection bid from the bidder's per impression bid to create a bid relevant to the auction. Such a constructive bid can be calculated using the per impression bid provided and a selection rate, as expressed in Eq. (7):

$$\text{Per selection bid} = \frac{\text{Per impression bid}}{\text{selection rate}} \tag{7}$$

The selection rate may include, for example, an estimated or an historical click-through rate that reflects the frequency with which the bidder's ad may be or has been selected, respectively, relative to the number of impressions of the ad. Thus, the bids, such as a set of bids 400 (FIG. 4), may be preprocessed to calculate bids that are relevant to the auction being conducted. Once the bids are preprocessed, at 308, pseudo bids are determined for each of the bids using the pseudo bid function determined at 302

FIG. 5, for example, shows a set of pseudo bids 500 derived from the set of bids 400 (FIG. 4). For purposes of the example, it is assumed that a pseudo bid function like that of Eq. (2) is selected with a value of λ set to 0.03. The specific pseudo bid function is given by Eq. (8):

$$\text{pseudo bid} = \text{bid price} - \frac{0.03}{\text{auction budget}} \tag{8}$$

As indicated by Eq. (8), the value of the pseudo bid is derived from the bid price minus the quantity of 0.03 divided by the auction budget. Eq. (8) is the same as Eq. (2) with the value of λ set to 0.03. Thus, the pseudo bid for Bidder A 410 is determined by calculating the value of the bid price 412 of $0.06 minus the quantity of 10 divided by the auction budget 414 of $1.50 to yield a pseudo bid 510 for Bidder A 410 of $0.040. Similarly, using Eq. (8), the pseudo bid 520 for Bidder B 420 is determined to be $0.030, and the pseudo bid 530 for Bidder C 430 is determined to be $0.038.

Ranking the pseudo bids 510, 520, and 530, the rank 512 of the pseudo bid 510 for Bidder A 410 is first, the rank 522 of the pseudo bid 520 for Bidder B 420 is third, and the rank 532 of the pseudo bid 530 for Bidder C 430 is second. At first glance, this may appear surprising because, the bid price 412 of Bidder A 410 and the bid price 422 of Bidder B 420 are both $0.06, and Bidder C 430 submitted a lower bid price 432 than Bidder B 420. However, Bidder C 430 submitted an auction budget 434 of $2.50 that is significantly larger than the $1.00 auction budget 424 of Bidder B 420. Because the pseudo bid function of Eq. (8) used to determine the pseudo bids considers not only the bid prices but also the auction budgets submitted, the relatively large auction budget 434 of $2.50 submitted by Bidder C 430 results in the pseudo bid 530 of Bidder C 430 surpassing the pseudo bid 520 of Bidder B 420.

In the set of pseudo bids 500 of FIG. 5, the auction budgets 414, 424, and 434 submitted by the bidders have been redesignated as "Remaining Budgets" 514, 524, and 534, respectively. In one mode of a pseudo bid process, while the initial pseudo bids are determined based upon the original auction budgets submitted, as items being auctioned are assigned to winning bidders, the auction budget of the bidder winning each item is debited for the sale price of the item. Debiting the auction budget of the winning bidder reduces the winning bidder's remaining auction budget and, as a result, reduces the winning bidder's pseudo bid, the effect of which is explained further below. In any case, because FIG. 5 shows an initial set of pseudo bids 500, before any items have been auctioned, the remaining auction budgets 514, 524, and 534 are initially identical to the submitted auction budgets 414, 424, and 434, respectively.

Figure 2:
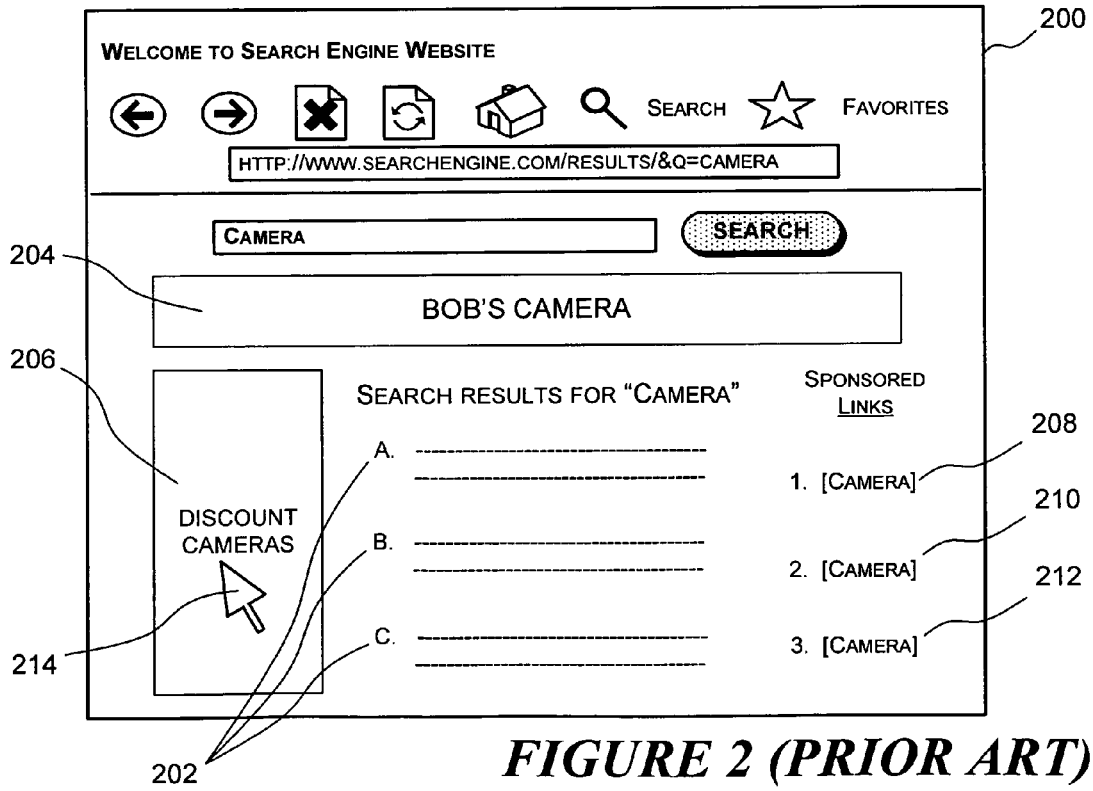
FIGURE 2 (PRIOR ART)

Referring to FIG. 3, at 310, it is determined if an item is available for auction. In the example of auctioning advertising opportunities, an item in the form of an advertising opportunity becomes available when a page on which one or more bidders wishes to advertise becomes available. If bidders seek to advertise services that may appeal to a broad range of users, the bidders may bid on any page providing news, e-mail, or other services. Thus, any time such a page is generated, an item becomes available for which bidders bid for the right to have their ads placed on such a page. In addition, as previously described, if the advertising provider operates a search engine site, bidders may bid for the right to have their ads inserted in advertising opportunities on a search results screen 200 (FIG. 2) when the search 102 (FIG. 1) includes one or more search terms on which the bidders have bid. If it is determined at 310 that no item has yet become available, process 300 loops to 310 until an item becomes available.

Once it is determined at 310 that an advertising opportunity has become available, at 312, the bid associated with the highest pseudo bid is identified as the winning bid. Thus, considering the example of FIG. 5, for the first item to become available, Bidder A 410 wins the item with a highest pseudo bid 510 of $0.045.

At 314, the item is auctioned to the bidder having the highest pseudo bid. At 316, the auction budget of the high bidder winning the last item is debited for the cost of the item. The cost of the item may be determined in a number of ways. The cost of the item could include the bid price submitted by the current high bidder, the bid price of the next highest bidder (on the basis of pseudo bids), the pseudo bid of the high bidder, the pseudo bid of the next highest bidder, or another market price. Examples of market prices selected are described further below in connection with the examples of FIGS. 7, 9, and 10.

At 318, according to one mode of auctioning by pseudo bids, the pseudo bid for the high bidder is recomputed. Computing pseudo bids as a result of a current or remaining auction budget is described by Eq. (9), where the auction budget term is replaced by a remaining auction budget term:

$$\text{pseudo bid} = \text{bid price} - \frac{0.03}{\text{remaining auction budget}} \tag{9}$$

As previously described, before any items have been auctioned and, thus, none of the bidders auction budgets have been debited, Eq. (9) is identical to Eq. (8) used to compute the initial pseudo bids.

Recalculating pseudo bids based on remaining auction budgets advantageously changes who is the current high bidder. Thus, a bidder submitting a high bid price and a high auction budget may win items early in an auction. However, as that bidder's auction budget is debited according to Eq. (9), its auction budget may fall below that of other bidders. As a result, the bidder's pseudo bid may fall below that of other bidders, allowing other bidders the chance to win items. As those bidders win items and their auction budgets are debited, their pseudo bids also will be reduced. Thus, the original high bidder's pseudo bid may once again become the high pseudo bid, allowing that bidder to win additional items throughout the course of the auction. Therefore, the use of pseudo bids not only recognizes and rewards bidders who submit high auction budgets, but also allows for items to be periodically won by other bidders throughout the auction period. The operation of the pseudo bidding to identify different winners throughout the course of an auction period is illustrated in the examples of FIGS. 7, 9 and 10.

At 320, it is determined if the auction will continue. The auction may not continue, for example, when none of the bidders have any auction budget remaining, when none of the bidders no longer can offer or do offer a bid at least equal to a reserve price for the item, or the auction period has lapsed. If it is determined at 320 that the auction continues, the process 300 loops to 310 to await the next determination that an item has become available for auction. Alternatively, at 322, the auction ends.

Examples of Auctions Based on Pseudo Bids

FIGS. 6 and 7 provide an example of how an auction is performed using pseudo bids according to the process 300 of FIG. 3. More specifically, the auction is for advertising opportunities on a per-impression basis. In the event that bidders submitted bids on a per selection basis, as previously described in connection with FIG. 3, the bids may be preprocessed to convert the bidders' bids into per impression bids.

FIG. 6 illustrates a set of bids 700 received from three bidders, Bidder A 610, Bidder B, 620, and Bidder C 630. Bidder A 610 submits a bid price 612 of $0.05 and an auction budget 614 of $1.50. Bidder B 620 submits a bid price 622 of $0.06, which is the highest bid price submitted, and an auction budget 624 of $1.00. Bidder C 630 submits a bid price 632 of $0.04, which is the lowest bid price submitted, and an auction budget 634 of $2.40, which is the highest auction budget submitted.

FIG. 7 illustrates sets of pseudo bids for ten rounds of an auction. Each of the sets of pseudo bids also indicates which of the bidders will win the next item to be auctioned as a result of the pseudo bids. For purposes of clarity of illustration and description, from this point forward, the bidders will be identified only as Bidders A, B, and C, without their reference number designations.

Pseudo bids for round 0 700 represent the initial pseudo bids to be used for the first item to be auctioned. Because no items have been auctioned, the remaining budgets for each of the bidders 614, 624, and 634 are equivalent to the original auction budgets submitted by each of the bidders. The pseudo bids are calculated according to Eq. (9), which is repeated here for convenience:

$$\text{pseudo bid} = \text{bid price} - \frac{0.03}{\text{remaining auction budget}} \tag{9}$$

Using Eq. (9), the initial pseudo bid 702 for Round 0 700 for Bidder A is $0.03000, the initial pseudo bid 704 for Round 0 700 for Bidder B also is $0.03000, and the initial pseudo bid 706 for Round 0 700 for Bidder C is $0.02750. For the purposes of the example of FIG. 7, pseudo-bids are rounded to five decimal places. Also for purposes of the example of FIG. 7, each of the bidders is charged its bid price for each item won. As previously described, and as is further described below, the price for each item could be set to the bid price submitted by a bidder with the current highest pseudo bid, the bid price submitted by the next highest bidder according to pseudo bids, or another price up to the bid price submitted by a bidder.

As indicated for Round 0 700, Bidder A's pseudo bid 702 of $0.03000 and Bidder B's pseudo bid 704 of $0.03000 are equal. In the event of a tie, various tie breakers, such as bid price, auction budget, some measure of bidder loyalty, or another measure may be used. For purposes of this example, bid price is used as the tie breaker. Accordingly, the next winner 708 determined for Round 0 700 is Bidder B.

For Round 1 710, Bidder B's remaining budget 712 has been reduced to $0.94 to reflect the cost of winning the first item. Because of the change in. Bidder B's remaining budget 712, Bidder B's pseudo bid 714, recalculated according to Eq. (6), is reduced to $0.02809. Thus, Bidder A's pseudo bid 716 is now the high bid, and the next winner 718 determined for Round 1 710 is Bidder A.

For Round 2 720, Bidder A's remaining budget 722 has been reduced to $1.45 to reflect the cost of winning the first item. Despite the reduction in Bidder A's remaining budget 722, Bidder A's recalculated pseudo bid 724 still exceeds Bidder B's next closest pseudo bid 726 of $0.02809. Thus, Bidder A's pseudo bid 726 once again is the high bid, and the next winner 728 determined for Round 2 720 is Bidder A.

Similarly, for Round 3 730, despite the reduction in Bidder A's remaining auction budget 732 to $1.40, Bidder A's pseudo bid 734 is still greater than the next closest pseudo bid 736 of Bidder B. Thus, Bidder A again is the next winner 738 of the next item to be auctioned. Thus, despite Bidder A submitting an initial bid price 612 (FIG. 6) equal to that of the initial bid price 622 of Bidder B, Bidder A is winning more items. Bidder A continues to win more items because, using a mode of pseudo bidding, Bidder A submitted an initial auction budget 614 greater than the initial auction budget 624 submitted by Bidder B, resulting in Bidder A having higher pseudo bids in three of four rounds.

However, as indicated by the calculations for Round 4 740, an advantage of modes of auctioning by pseudo bids, although Bidder A prevailed in the last three rounds as a result of its high auction budget, Bidder B will still be able to win items. In Round 4 740, Bidder A's remaining budget 742 is reduced to $1.35, resulting in Bidder A's pseudo bid 744 being reduced to $0.02778. Bidder A's pseudo bid 744 is now less than Bidder B's pseudo bid 746 of $0.02809. Accordingly, Bidder B is the next winner 748 determined in Round 4 740. In a mode of pseudo bidding where pseudo bids are a function of remaining auction budgets, other bidders are able to win items when a formerly higher pseudo bidder's remaining auction budget is reduced to reflect earlier winnings.

However, even though Bidder B prevailed in Round 4 740, because Bidder B's remaining auction budget 752 has been reduced to reflect winning the item auctioned in Round 4 740, in Round 5 750, Bidder B's pseudo bid 754 of $0.02591 once again ranks below Bidder A's pseudo bid of $0.02778. Thus, Bidder A is the next winner 758 determined in Round 5 750. Thus, using a mode of auctioning by pseudo bids reductions in remaining auction budgets not only allow other bidders to win items, but also allows previous winners to later win additional items.

In Round 6 760, with Bidder A's remaining auction budget 762 being reduced to $1.30 and its pseudo bid 764 falling to $0.02692, Bidder C's pseudo bid 766 of $0.02750 now becomes the high pseudo bid. Thus, Bidder C becomes the next winner 778 for Round 6.

As previously described in connection with FIG. 6, Bidder C submitted a bid price 632 that was less than the bid price 612 of Bidder A and the bid price 622 of Bidder B. However, because pseudo bids consider auction budget as well as bid price, Bidder C's commitment of a relatively large auction budget 634 of $2.40 allows Bidder C to win items, even when Bidder A and Bidder B still have funds in their auction budgets sufficient to purchase other items. By committing a relatively large auction budget, as in the case of Bidder C, a bidder offering a lower bid price may be rewarded by being able to win items early in the auction period.

In Round 7 700, even with Bidder C's auction budget 772 reduced to $2.36 as a result of winning the last item auctioned, Bidder C's pseudo bid 774 of $0.02729 remains larger than Bidder A's pseudo bid 776 of $0.02692. Thus, once again by virtue of its large auction budget, Bidder C is determined to be the next winner 778 of Round 7. Similarly, in Round 8 780, because of the relatively large remaining auction budget 782 of Bidder C resulting in a large denominator in the negative term of Eq. (6), Bidder C's pseudo bid 784 continues to exceed the next closest pseudo bid 796 of Bidder A at $0.02692. Again, the next winner 788 of Round 8 is Bidder C.

However, despite Bidder C's large auction budget, in Round 9 790, Bidder C's remaining auction budget 792 is reduced to $2.28. As a result, Bidder A's pseudo bid 796 of $0.02692 now surpasses Bidder C's pseudo bid of 794 $0.02684, and Bidder A becomes the next winner 798 of Round 9.

In sum, using pseudo bids based on bid price and auction budget rewards bidders who commit a large auction budget to the auction. Furthermore, in a mode where pseudo bids are based on remaining auction budgets and recalculated after the sale of each item, which bidder wins each item is rotated between bidders that submit a sufficient combination of a bid price and an auction budget. Thus, bidders submitting high bid prices or high auction budgets will be able to win items throughout the auction period. This is distinct from conventional auctions where higher bidders may exhaust their auction budgets early, and lower bidders may not win any items (and thus not provide revenue for the advertising provider) until late in the auction period.

FIGS. 8, 9, and 10 illustrate additional examples of auctions using pseudo bids to show some of the possible variations that may be employed. FIG. 8 is a set of bids 800 in a per selection auction for advertising opportunities. Per selection bids, for which bidders pay when a user actually selects one of the bidders ads, tend to be considerably higher than per impression bids. For example, Bidder A 802 submits a bid price 804 of $2.00 and an auction budget 804 of $50. Bidder B 812 submits a bid price 814 of $2.08 and an auction budget 814 of $35, and Bidder C 802 submits a bid price 824 of $1.95 and an auction budget 824 of $70. Again, as previously described, if any of the bidders submitted a per impression bid rather than a per selection bid, the bid could be preprocessed to convert the per impression bid into a relevant per selection bid.

FIG. 9 shows the results of six rounds of the auction. Eq. (10) defines the pseudo bid function used to determine the pseudo bids:

$$\text{pseudo bid} = \text{bid price} - \frac{10}{\text{remaining auction budget}} \tag{10}$$

Eq. (10) is the same as Eq. (9), except that the value of $\lambda$ has been set to 10 instead of 0.03. The higher value of $\lambda$ results in an appropriately larger offset term based on the remaining auction budget to offset the higher bid prices submitted in a per selection auction.

Using Eq. (10) as the pseudo bid function, for Round 0 900, the remaining auction budgets are equated with the initial auction budgets 806, 816, and 826 for Bidders A, B, and C, respectively. Using the bid prices and auction budgets submitted, rounded to five decimal places, Bidder A's pseudo bid 902 is $1.80000, Bidder B's pseudo bid 904 is $1.79429, and Bidder C's pseudo bid 906 is $1.80714. Although Bidder C submitted the lowest bid price 824 of $1.95, by committing a relatively large auction budget, Bidder C's pseudo bid 906 is the largest pseudo bid. Thus, Bidder C is designated as the next winner 908 for Round 0 900.

Instead of auctioning the items for the bid price submitted by each of the bidders, in this auction a winning bidder pays the amount of money that it would cost to make its pseudo bid equal to or greater than the pseudo bid of the next highest bidder. Thus, pseudo bidding can incorporate a Vickery type auction, except the price of the item is based on the pseudo bid of the next highest bidder, rather than the bid of the next highest bidder. Determining the cost the winner should pay is determined by solving Eq. (10) for the bid price, because the pseudo bid is known, as described by Eq. (11):

$$\text{item price} = \text{next pseudo bid} + \frac{10}{\text{remaining auction budget}} \tag{11}$$

In the example of Round 0 900, the next winner 908 is Bidder C at a price of $1.94. The price of $1.94 is determined by substituting the next highest pseudo bid, Bidder A's pseudo bid 902 of $1.80, and the remaining auction budget 826 of Bidder C of $70, as described by Eq. (8):

$$1.94286 = \$1.80000 + \frac{10}{\$70} \tag{12}$$

In this example, the price is rounded to two decimal places.

It should be noted that modes of conducting an auction using pseudo bids are not limited as to what prices are charged to bidders for the items being auctioned. Winning bidders may be charged their own bid price, the bid price by next highest bidders, prices derived from their pseudo bids or pseudo bids of others, or some combination of bids, pseudo bids, and other relevant values.

In Round 0 900, Bidder C benefited from the pseudo bid auction in two ways. First, despite not submitting the highest bid price, because Bidder C committed a relatively high auction budget, Bidder C was rewarded with a relatively high pseudo bid that won Round 0 900 of the auction. Second, because this mode determines the price based on what Bidder C would have had to pay to present a pseudo bid at least as high as the next highest pseudo bid, instead of paying its bid price, Bidder C paid $1.94, $0.01 less than its bid price.

In Round 1 910, Bidder C's remaining auction budget 912 is reduced to $68.06 to reflect the debit of $1.94 for winning Round 0 900. Using Eq. (6), Bidder C's pseudo bid 914 is reduced to $1.80307, which is still the highest pseudo bid. Thus, the next winner 918 of Round 1 910 is Bidder C. This time, the price is $1.95, derived from substitute Bidder C's remaining auction budget 912 and Bidder A's next highest pseudo bid 916 of $1.80000 into Eq. (11).

In Round 2 920, Bidder C's remaining auction budget 922 is reduced to $66.11 to reflect the additional debit of $1.95 for winning Round 1 910. Bidder C's pseudo bid 924 is reduced to $1.79874, which is now lower than the pseudo bid 926 of $1.80000 of Bidder A. Thus, Bidder A is the next winner 928 at a cost of $2.00, which again is calculated using Eq. (11).

In Round 3 930, Bidder A's remaining auction budget 932 is reduced to $48.00 to reflect the debit of $2.00 for winning Round 2 920. Bidder A's pseudo bid 934 is reduced to $1.79167, which is less than pseudo bid 936 of Bidder C. The next winner 938 of Round 3 930 is Bidder C at a cost of $1.95.

In Round 4, 940, Bidder C's auction budget 942 is further reduced to $64.16 to reflect winning the item auctioned in Round 3 930. Bidder C's reduced pseudo bid 944 now falls below Bidder B's pseudo bid 946. Bidder B is the winner 948 of Round 4 940 at a cost of $2.08. Thus, even though Bidder B committed a relatively small auction budget to the auction, because of its relatively high bid price, Bidder B is able to win an item early in the auction.

Finally, in Round 5 950, Bidder B's remaining auction budget 952 is reduced to $32.92, and its pseudo bid 954 is reduced to $1.77623, which is less than Bidder A's pseudo bid 956 of $1.70167. Thus, Bidder A is the winner 958 of Round 5 at a cost of $2.00. Thus, using pseudo bids dependent on bid price and auction budget, all three bidders are able to alternately win items in an auction using pseudo bids.

FIG. 10 is example of another mode of auction using pseudo bids. However, in the rounds of the auction described in FIG. 10, a different pseudo function is used to determine the pseudo bids for one of the bidders, in particular, Bidder B.

In modes of auctioning according to pseudo bids, the pseudo function is dependent upon the bid price and the auction budget. In the case of Eq. (10) that is used to determine the pseudo bids in the examples of FIGS. 9 and 10, the pseudo bid function includes the bid price offset by a term that includes the reciprocal of the auction budget or the remaining auction budget:

$$\text{pseudo bid} = \text{bid price} - \frac{10}{\text{remaining auction budget}} \tag{6}$$

As shown in the foregoing examples, bidders submitting larger auction budgets will post higher pseudo bids because the offset term to the bid price decreases with higher auction budgets and remaining auction budgets.

Considering the exemplary pseudo bid function of Eq. (10), the offset term also may be reduced by reducing the numerator of the offset term, such as by reducing the value from $\lambda=10$ to $\lambda=9$. A bidder would prefer a smaller value of $\lambda$, because a smaller value of $\lambda$ will result in the bidder's pseudo bid being reduced by a smaller amount when the bidder wins items and its remaining auction budget is reduced. In particular, a bidder would have an advantage if its pseudo bid function uses a lower value of $\lambda$ than used in the pseudo bid functions of other bidders.

Advertising providers also may benefit from being able to assign different pseudo bid functions to different bidders. For example, the advertising provider may assign advantageous pseudo bid functions to advertisers who commit to bidding on a certain number of auctions or who commit to auction budgets over a certain level to promote advertiser loyalty and to reward advertisers who invest significant advertising funds with the advertising provider. Advertising providers also may offer an advantageous pseudo bid function to new advertisers to entice them to bid on advertising opportunities auctioned by the advertising provider. Further, an advertiser may sell or trade advantageous pseudo bid functions for some other consideration.

FIG. 10 shows the results of six rounds of an auction where the same three bidders, Bidders A, B, and C, have submitted the same bid prices and auction budgets described in FIG. 8. However, in the example of FIG. 10, for promotional, reward, or loyalty reasons, the pseudo bid function, a more favorable pseudo bid function is applied to Bidder B. More specifically, the pseudo bid function of Bidder B is the same as Eq. (10), except that a value of $\lambda=9$ is substituted for $\lambda=10$, as described in Eq. (13):

$$\text{pseudo bid} = \text{bid price} - \frac{9}{\text{remaining auction budget}} \tag{13}$$

FIG. 10 illustrates how a bidder who is assigned an advantageous pseudo bid function may benefit.

Round 0 1000 shows the initial pseudo bids for Bidders A, B, and C. Using Eq. (6), Bidder A's initial pseudo bid 1002 is $1.80000 and Bidder C's initial pseudo bid 1006 is $1.80714. In the auction of FIG. 9, Bidder C's initial pseudo bid 906 of $1.80714 was enough to win Round 0. Here, however, although Bidder B submitted the same bid price and auction budget, using Eq. (13), Bidder B's initial pseudo bid 1004 is $1.82286, making Bidder B the winner 1006 of Round 0 1000 at a price of $2.07. As in the auction of FIG. 9, the prices are determined from Eq. (11) to determine what the bidder with the high pseudo bid would have to pay for its pseudo bid to match the second highest pseudo bid.

In Round 1 1010, Bidder B's remaining auction budget 1012 is reduced to $32.93 as a result of being debited for the item won in Round 0 1000. Thus, Bidder B's pseudo bid 1014 is reduced to $1.80669, which is now less than Bidder C's pseudo bid 1016 of $1.80714. Thus, the winner 1018 of Round 1 1010 is Bidder C at a price of $1.95. However, in Round 2 1020, once Bidder C's remaining auction budget 1022 is reduced to $68.05, Bidder C's pseudo bid 1024 drops to $1.80305. Bidder B's pseudo bid 1026 of $1.80669 is higher than Bidder C's pseudo bid 1024, thus, the winner 1028 of Round 2 1020 is Bidder B at a price of $2.07.

In the five rounds of the auction of FIG. 9, Bidder B won only Round 4 940. However, in the auction of FIG. 10, in only three rounds and having submitted the same bid price and auction budget, Bidder B quickly won Round 0 1000 and Round 2 1020. In addition, Bidder B also will pay a more favorable price when Bidder B wins a round. As previously described, the price paid by a winning bidder with a pseudo bid function using $\lambda=10$ is determined by Eq. (11):

$$\text{item price} = \text{next pseudo bid} + \frac{10}{\text{remaining auction budget}} \tag{11}$$

However, reducing for $\lambda$ from 10 to 9, the item price for Bidder B is determined using Eq. (14):

$$\text{item price} = \text{next pseudo bid} + \frac{9}{\text{remaining auction budget}} \tag{14))}$$

Thus, an advantageous pseudo function benefits Bidder B both in being able to post more competitive pseudo bids, but also in paying more favorable prices for its items.

In the example of FIG. 10, only a single bidder was assigned an advantageous pseudo bid function. However, any number of bidders can be assigned different pseudo bid functions at the discretion of the advertising provider.

Computing System for Implementing Exemplary Embodiments

Figure 11:
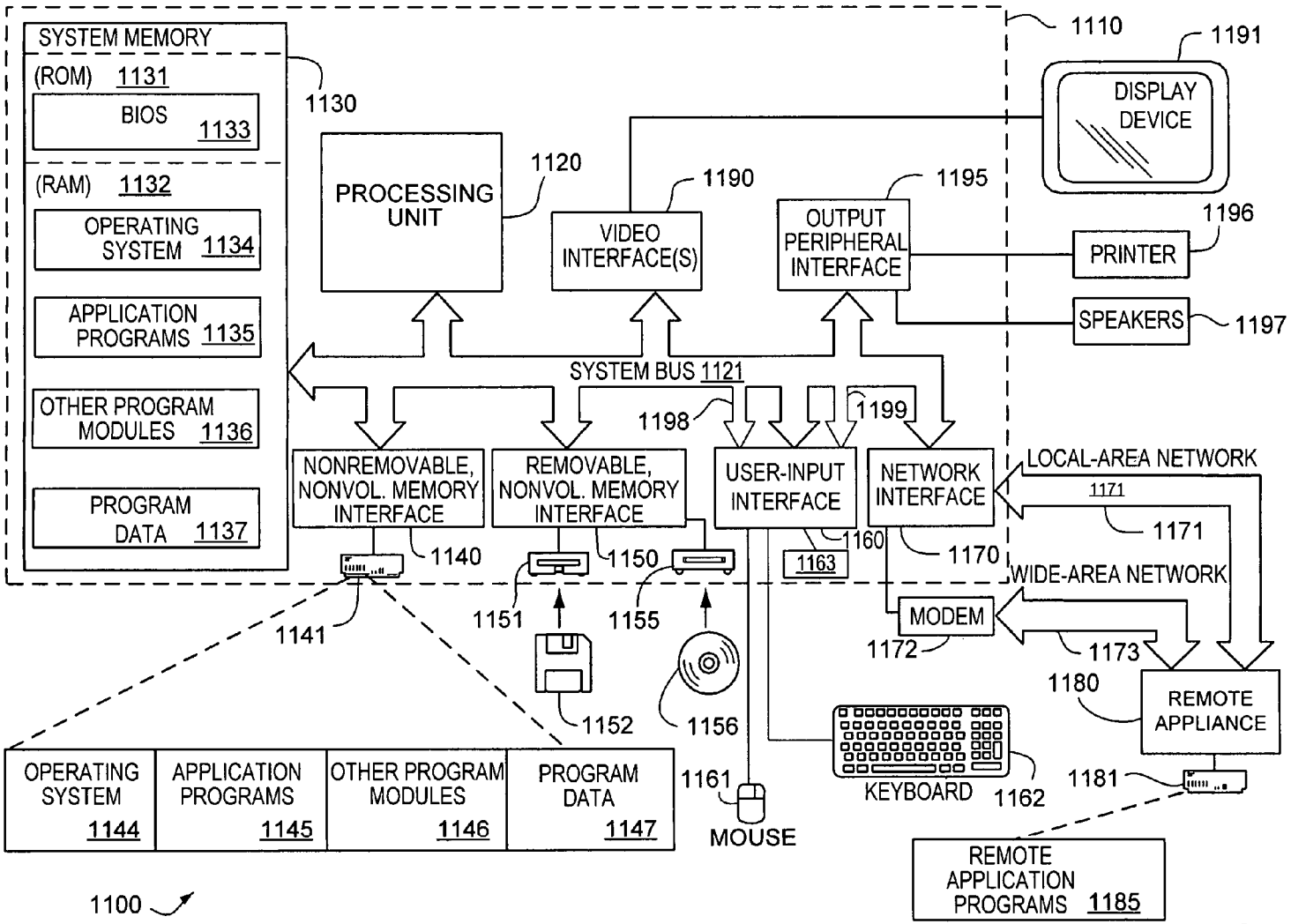
FIG. 11 is a block diagram of a computing-system environment suitable for use with conducting an auction using pseudo bids.

FIG. 11 illustrates an exemplary computing system 1100 for implementing embodiments of the pseudo bid auction process. The computing system 1100 is only one example of a suitable operating environment and is not intended to suggest any limitation as to the scope of use or functionality of exemplary embodiments of the pseudo bid auction process previously described or other embodiments. Neither should the computing system 1100 be interpreted as having any dependency or requirement relating to any one or combination of components illustrated in the exemplary computing system 1100.

The pseudo bid auction process may be described in the general context of computer-executable instructions, such as program modules, being executed on computing system 1100. Generally, program modules include routines, programs, objects, components, data structures, etc., that perform particular tasks or implement particular abstract data types. Moreover, those skilled in the art will appreciate that the pseudo bid auction process may be practiced with a variety of computer-system configurations, including hand-held devices, multiprocessor systems, microprocessor-based or programmable-consumer electronics, minicomputers, mainframe computers, and the like. The pseudo bid auction process may also be practiced in distributed-computing environments where tasks are performed by remote-processing devices that are linked through a communications network. In a distributed-computing environment, program modules may be located in both local and remote computer-storage storage media including memory-storage devices.

With reference to FIG. 11, an exemplary computing system 1100 for implementing the pseudo bid auction process includes a computer 1110 including a processing unit 1120, a system memory 1130, and a system bus 1121 that couples various system components including the system memory 1130 to the processing unit 1120.

Computer 1110 typically includes a variety of computer-readable media. By way of example, and not limitation, computer-readable media may comprise computer-storage media and communication media. Examples of computer-storage media include, but are not limited to, Random Access Memory (RAM); Read Only Memory (ROM); Electronically Erasable Programmable Read Only Memory (EEPROM); flash memory or other memory technology; CD ROM, digital versatile discs (DVD) or other optical or holographic disc storage; magnetic cassettes, magnetic tape, magnetic disk storage or other magnetic storage devices; or any other medium that can be used to store desired information and be accessed by computer 1110. The system memory 1130 includes computer-storage media in the form of volatile and/or nonvolatile memory such as ROM 1131 and RAM 1132. A Basic Input/Output System 1133 (BIOS), containing the basic routines that help to transfer information between elements within computer 1110 (such as during start-up) is typically stored in ROM 1131. RAM 1132 typically contains data and/or program modules that are immediately accessible to and/or presently being operated on by processing unit 1120. By way of example, and not limitation, FIG. 11 illustrates operating system 1134, application programs 1135, other program modules 1136, and program data 1137.

The computer 1110 may also include other removable/nonremovable, volatile/nonvolatile computer-storage media. By way of example only, FIG. 11 illustrates a hard disk drive 1141 that reads from or writes to nonremovable, nonvolatile magnetic media, a magnetic disk drive 1151 that reads from or writes to a removable, nonvolatile magnetic disk 1152, and an optical-disc drive 1155 that reads from or writes to a removable, nonvolatile optical disc 1156 such as a CD-ROM or other optical media. Other removable/nonremovable, volatile/nonvolatile computer-storage media that can be used in the exemplary operating environment include, but are not limited to, magnetic tape cassettes, flash memory units, digital versatile discs, digital video tape, solid state RAM, solid state ROM, and the like. The hard disk drive 1141 is typically connected to the system bus 1121 through a nonremovable memory interface such as interface 1140. Magnetic disk drive 1151 and optical dick drive 1155 are typically connected to the system bus 1121 by a removable memory interface, such as interface 1150.

The drives and their associated computer-storage media discussed above and illustrated in FIG. 11 provide storage of computer-readable instructions, data structures, program modules and other data for computer 1110. For example, hard disk drive 1141 is illustrated as storing operating system 1144, application programs 1145, other program modules 1146, and program data 1147. Note that these components can either be the same as or different from operating system 1134, application programs 1135, other program modules 1136, and program data 1137. Typically, the operating system, application programs, and the like that are stored in RAM are portions of the corresponding systems, programs, or data read from hard disk drive 1141, the portions varying in size and scope depending on the functions desired. Operating system 1144, application programs 1145, other program modules 1146, and program data 1147 are given different numbers here to illustrate that, at a minimum, they can be different copies. A user may enter commands and information into the computer 1110 through input devices such as a keyboard 1162; pointing device 1161, commonly referred to as a mouse, trackball or touch pad; a wireless-input-reception component 1163; or a wireless source such as a remote control. Other input devices (not shown) may include a microphone, joystick, game pad, satellite dish, scanner, or the like. These and other input devices are often connected to the processing unit 1120 through a user-input interface 1160 that is coupled to the system bus 1121 but may be connected by other interface and bus structures, such as a parallel port, game port, IEEE 1394 port, or a universal serial bus (USB) 1198, or infrared (IR) bus 1199. As previously mentioned, input/output functions can be facilitated in a distributed manner via a communications network.

A display device 1191 is also connected to the system bus 1121 via an interface, such as a video interface 1190. Display device 1191 can be any device to display the output of computer 1110 not limited to a monitor, an LCD screen, a TFT screen, a flat-panel display, a conventional television, or screen projector. In addition to the display device 1191, computers may also include other peripheral output devices such as speakers 1197 and printer 1196, which may be connected through an output peripheral interface 1195.

The computer 1110 will operate in a networked environment using logical connections to one or more remote computers, such as a remote computer 1180. The remote computer 1180 may be a personal computer, and typically includes many or all of the elements described above relative to the computer 1110, although only a memory storage device 1181 has been illustrated in FIG. 11. The logical connections depicted in FIG. 11 include a local-area network (LAN) 1171 and a wide-area network (WAN) 1173 but may also include other networks, such as connections to a metropolitan-area network (MAN), intranet, or the Internet.

When used in a LAN networking environment, the computer 1110 is connected to the LAN 1171 through a network interface or adapter 1170. When used in a WAN networking environment, the computer 1110 typically includes a modem 1172 or other means for establishing communications over the WAN 1173, such as the Internet. The modem 1172, which may be internal or external, may be connected to the system bus 1121 via the network interface 1170, or other appropriate mechanism. Modem 1172 could be a cable modem, DSL modem, or other broadband device. In a networked environment, program modules depicted relative to the computer 1110, or portions thereof, may be stored in the remote memory storage device. By way of example, and not limitation, FIG. 11 illustrates remote application programs 1185 as residing on memory device 1181. It will be appreciated that the network connections shown are exemplary, and other means of establishing a communications link between the computers may be used.

Although many other internal components of the computer 1110 are not shown, those of ordinary skill in the art will appreciate that such components and the interconnections are well-known. For example, including various expansion cards such as television-tuner cards and network-interface cards within a computer 1110 is conventional. Accordingly, additional details concerning the internal construction of the computer 1110 need not be disclosed in describing exemplary embodiments of the pseudo bid auction process.

When the computer 1110 is turned on or reset, the BIOS 1133, which is stored in ROM 1131, instructs the processing unit 1120 to load the operating system, or necessary portion thereof, from the hard disk drive 1141 into the RAM 1132. Once the copied portion of the operating system, designated as operating system 1144, is loaded into RAM 1132, the processing unit 1120 executes the operating system code and causes the visual elements associated with the user interface of the operating system 1134 to be displayed on the display device 1191. Typically, when an application program 1145 is opened by a user, the program code and relevant data are read from the hard disk drive 1141 and the necessary portions are copied into RAM 1132, the copied portion represented herein by reference numeral 1135.

CONCLUSION

Although exemplary embodiments have been described in language specific to structural features and/or methodological acts, it is to be understood that the appended claims are not necessarily limited to the specific features or acts previously described. Rather, the specific features and acts are disclosed as exemplary embodiments.

The invention claimed is:

1. A computer-readable medium having computer-useable executable instructions embodied thereon performing a method for identifying winning bids in an auction, comprising:

receiving a plurality of bids during an auction period, each bid of the plurality of bids including a bid price and an auction budget;

determining a pseudo bid function dependent on at least the bid price and the auction budget included in each bid of the plurality of bids;

determining a pseudo bid for each of the plurality of bids using the pseudo bid function, wherein determining further comprises:

increasing the pseudo bid by increasing the bid price and increasing the auction budget;

determining a remaining portion of advertising opportunities for the auction period based on a historical projection or an estimated projection;

calculating a ratio of a remaining portion of the auction budget for the auction period to the remaining portion of the advertising opportunities for the auction period;

adjusting the pseudo bid based on the ratio;

ranking the pseudo bids of the plurality of bids; and identifying a bid associated with a highest pseudo bid as a winning bid.

2. A computer-readable medium of claim 1, wherein the auction is conducted for the sale of the advertising opportunities presented over a network, and the bid price includes one of:

a per impression bid;

a per selection bid;

a constructive per impression bid derived from the per selection bid and a selection rate representing a frequency with which an advertisement presented over the network is selected; and a constructive per selection bid derived from the per impression bid and the selection rate.

3. A computer-readable medium of claim 1, wherein the pseudo bid function includes a function having a value that increases with an additional ratio of an additional remaining portion of the auction budget for an additional auction period to an expected remaining portion of items to be auctioned.

4. A computer-readable medium of claim 3, wherein the pseudo bid function includes at least one of:

a uniform pseudo bid function applied to the plurality of bids; and a variable pseudo bid function applying an adjusted pseudo bid function to at least one selected bid as a result of at least one of direction of a seller and a property of the selected bid.

5. A computer-readable medium of claim 4, further comprising applying the variable pseudo bid function to at least one favored bidder affording the at least one favored bidder at least one of:

an increased pseudo bid; and a reduced price for an item won by the favored bidder.

6. A computer-readable medium of claim 1, further comprising selling an item to a bidder presenting the winning bid.

7. A computer-readable medium of claim 6, further comprising debiting the auction budget of the current high bidder by a current price for the item to yield a remaining auction budget.

8. A computer-readable medium of claim 7, wherein the current price includes one of:

a winning bid price associated with the winning bid;

a market price that is one of less than or equal to the winning bid;

a highest pseudo bid;

a second-highest pseudo bid;

a constructive bid price which, substituted for the bid price in the pseudo bid function, yields a constructive pseudo bid at least equal to the second highest pseudo bid; and a derivative value proportional to at least one of the highest pseudo bid, the winning bid, the second-highest pseudo bid, and the constructive bid price.

9. A computer-readable medium of claim 7, wherein the pseudo bid for the current high bidder is recalculated based on the remaining auction budget.

10. A system configured for identifying winning bids in an auction, the system comprising:

processor;

a memory communicatively coupled to the processor, the memory having stored therein computer-executable instructions to implement the system, including:

receiving a plurality of bids during an auction period, each bid of the plurality of bids including a bid price and an auction budget;

determining a pseudo bid function dependent on at least the bid price and the auction budget included in each bid of the plurality of bids;

determining a pseudo bid for each of the plurality of bids using the pseudo bid function, wherein determining further comprises:

increasing the pseudo bid by increasing the bid price and increasing the auction budget;

determining a remaining portion of advertising opportunities for the auction period based on a historical projection or an estimated projection;

calculating a ratio of a remaining portion of the auction budget for the auction period to the remaining portion of the advertising opportunities for the auction period;

adjusting the pseudo bid based on the ratio;

ranking the pseudo bids of the plurality of bids; and identifying a bid associated with a highest pseudo bid as a winning bid.

11. A system of claim 10, wherein the system is further programmed to perform functions including:

debiting the auction budget of the current high bidder by a current price for the item to yield a remaining auction budget; and recalculating the pseudo bid of the current high bidder based on the remaining auction budget.

12. A system of claim 10, wherein the system is further programmed to apply a pseudo bid function including at least one of:

a uniform pseudo bid function applied to the plurality of bids; and a variable pseudo bid function applying an adjusted pseudo bid function to at least one selected bid as a result of at least one of direction of a seller and a property of the selected bid.

* * * * *